US009693632B2

(12) United States Patent
Duke

(10) Patent No.: US 9,693,632 B2
(45) Date of Patent: Jul. 4, 2017

(54) CHAIR AND CHAIR TILT CONTROL ASSEMBLY

(71) Applicant: Aaron Duke, Orangeville, CA (US)

(72) Inventor: Aaron Duke, Orangeville, CA (US)

( * ) Notice: Subject to any disclaimer, the term of this patent is extended or adjusted under 35 U.S.C. 154(b) by 56 days.

(21) Appl. No.: 14/404,931

(22) PCT Filed: Jun. 3, 2013

(86) PCT No.: PCT/CA2013/000539

§ 371 (c)(1),
(2) Date: Dec. 1, 2014

(87) PCT Pub. No.: WO2013/177690

PCT Pub. Date: Dec. 5, 2013

(65) Prior Publication Data

US 2015/0123441 A1 May 7, 2015

Related U.S. Application Data

(60) Provisional application No. 61/654,238, filed on Jun. 1, 2012.

(51) Int. Cl.

| | |
|---|---|
| ***A47C 3/025*** | (2006.01) |
| ***A47C 1/032*** | (2006.01) |
| ***A47C 7/00*** | (2006.01) |

(52) U.S. Cl.

CPC ..... *A47C 3/0252* (2013.01); *A47C 1/03205* (2013.01); *A47C 1/03255* (2013.01);
(Continued)

(58) Field of Classification Search

CPC ..... A47C 1/03266; A47C 1/03272; A47C 1/03277; A47C 7/441; A47C 7/443; A47C 7/445

See application file for complete search history.

(56) References Cited

U.S. PATENT DOCUMENTS 4,890,886 A * 1/1990 Opsvik ..... A47C 3/025 248/596
5,080,318 A * 1/1992 Takamatsu ..... A47C 3/026 248/598

(Continued)

FOREIGN PATENT DOCUMENTS

GB 2167947 A 6/1986

OTHER PUBLICATIONS

PCT/CA2013/000539, International Search Report, Sep. 27, 2013.

*Primary Examiner* — David R Dunn
*Assistant Examiner* — Tania Abraham
(74) *Attorney, Agent, or Firm* — Millman IP Inc.

(57) ABSTRACT

In an aspect, the invention is directed to a chair that has a pedestal and an upper assembly including a body support assembly and a tilt control assembly. A biasing member is provided to bias the body support assembly towards an unreclined position. When the chair is empty the biasing member has a certain preload. When a person sits in the chair or when a downward force is applied to the upper assembly, there is relative movement between two chair components which causes an increase in the preload in the biasing member as compared to the preload when the chair is empty. As the downward force on the upper assembly increases, the preload in the biasing member increases.

4 Claims, 21 Drawing Sheets

(52) U.S. Cl.
CPC ..... *A47C 1/03266* (2013.01); *A47C 1/03272* (2013.01); *A47C 1/03277* (2013.01); *A47C 7/004* (2013.01); *A47C 7/006* (2013.01)

(56) References Cited

U.S. PATENT DOCUMENTS

| | | | | |
|---|---|---|---|---|
| 5,348,372 | A | 9/1994 | Takamatsu et al. | |
| 5,499,861 | A * | 3/1996 | Locher | A47C 1/03255 297/301.2 |
| 5,871,256 | A | 2/1999 | Kogai | |
| 5,909,924 | A * | 6/1999 | Roslund, Jr. | A47C 1/03255 297/300.4 |
| 5,964,503 | A * | 10/1999 | Inoue | A47C 1/03255 297/300.1 |
| 6,033,020 | A * | 3/2000 | Ito | A47C 1/026 297/302.4 |
| 6,386,634 | B1 | 5/2002 | Stumpf et al. | |
| 6,439,661 | B1 * | 8/2002 | Brauning | A47C 1/023 297/300.2 |
| 6,450,577 | B1 * | 9/2002 | Roslund, Jr. | A47C 1/03238 297/300.4 |
| 6,523,896 | B1 * | 2/2003 | Uhlenbrock | A47C 1/032 297/300.3 |
| 6,709,058 | B1 | 3/2004 | Diffrient | |
| 7,566,097 | B2 | 7/2009 | Sander et al. | |
| 7,798,573 | B2 | 9/2010 | Pennington et al. | |
| 7,992,937 | B2 * | 8/2011 | Plikat | A47C 1/03255 297/300.2 |
| 8,146,990 | B2 | 4/2012 | Bock | |
| 2006/0163925 | A1 | 7/2006 | Bock | |
| 2009/0267394 | A1 | 10/2009 | Bock | |

* cited by examiner

CHAIR AND CHAIR TILT CONTROL ASSEMBLY

CROSS-REFERENCE TO RELATED APPLICATIONS

This application claims the benefit of U.S. Provisional Patent Application 61/654,238 filed Jun. 1, 2012, the entire contents of which is incorporated herein by reference.

FIELD

The present invention relates to chair tilt control assemblies and more particularly to such assemblies that are capable of adjusting the force with which the chair resists reclining by a user.

BACKGROUND

Chairs, in particular office chairs, include, pedestals, seats and backrests, and tilt mechanisms that permit the chair to recline. Some proposed chairs suggest a mechanism that provides a resistance to reclining that varies based on the weight of the person sitting in the chair. However, such chairs suffer from several problems. One problem is that the mechanisms can be relatively expensive to manufacture, involving in some instances a large number of components, and/or components that are relatively complex to manufacture. It would be beneficial to provide a chair with a tilt mechanism that at least partially addresses these and other problems.

SUMMARY

In a first aspect, the invention is directed to a chair that has a pedestal and an upper assembly including a body support assembly and a tilt control assembly. A biasing member is provided to bias the body support assembly towards an unreclined position. When the chair is empty the biasing member has a certain preload. When a person sits in the chair or when a downward force is applied to the upper assembly, there is relative movement between two chair components which causes an increase in the preload in the biasing member as compared to the preload when the chair is empty. As the downward force on the upper assembly increases, the preload in the biasing member increases.

In a second aspect, the invention is directed to a chair that has a pedestal and an upper assembly including a body support assembly and a tilt control assembly, wherein an upper assembly biasing member biases the upper assembly towards a rest position. The upper assembly biasing member has a first end that engages an abutment surface on the pedestal. The abutment surface is an upper surface on the pedestal.

In a third aspect, the invention is directed to a chair that has a pedestal and an upper assembly including a body support assembly and a tilt control assembly, wherein a torsion spring biases the upper assembly towards a rest position. The torsion spring has a first end that engages an abutment surface on the pedestal. A downward force on the upper assembly causes the upper assembly to move downwards relative to the abutment surface, along a path that moves the position of a contact area between the abutment surface and the torsion spring.

In a fourth aspect, the invention is directed to a chair that has a pedestal and an upper assembly including a body support assembly and a tilt control assembly, wherein the body support assembly is biased towards an unreclined position by a body support assembly biasing member. A downward force on the upper assembly (e.g. from a person sitting on the chair) causes the spring rate of the body support assembly biasing member to change.

BRIEF DESCRIPTION OF THE DRAWINGS

Embodiments of the present invention will now be described by way of example only with reference to the attached drawings, in which.

DETAILED DESCRIPTION

In this specification and in the claims, the use of the article "a", "an", or "the" in reference to an item is not intended to exclude the possibility of including a plurality of the item in some embodiments of the invention. It will be apparent to one skilled in the art in at least some instances in this specification and the attached claims that it would be possible to include a plurality of the item in at least some embodiments of the invention.

Figure 1:
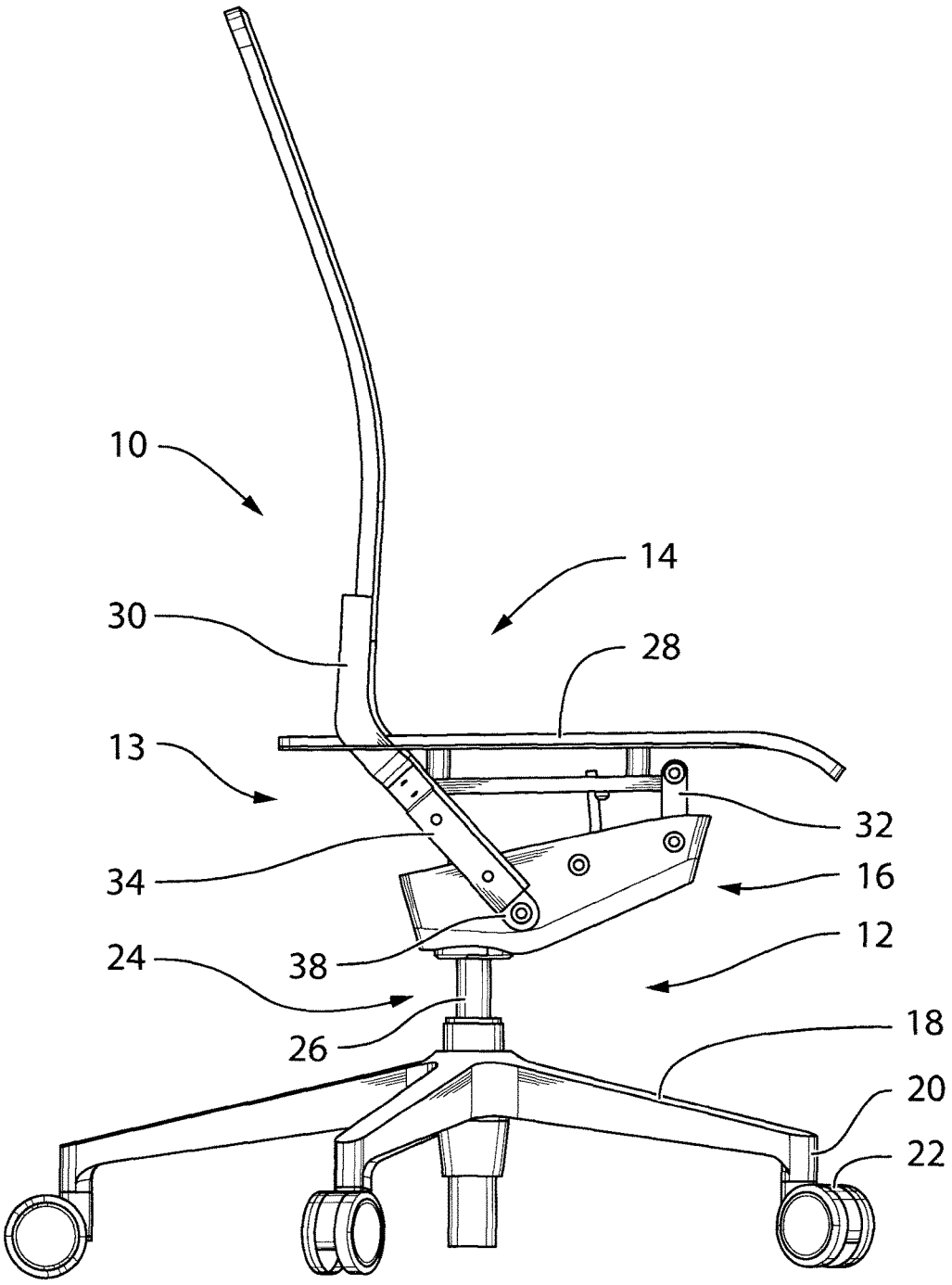
FIG. 1 is a side view of a chair in accordance with an embodiment of the present invention.

Reference is made to FIG. 1, which shows a chair 10 in accordance with an embodiment of the present invention. The chair 10 includes a pedestal 12 and an upper assembly 13, which includes a body support assembly 14, and a tilt control assembly 16. The pedestal 12 supports the rest of the chair 10 on a support surface, such as a floor. The pedestal 12 includes a base 18 that may be formed from a plurality of legs 20, as shown in FIG. 1, or alternatively from a single piece. The base 18 may include wheels 22, as shown in FIG. 1 on each of the legs 20. The pedestal 12 may further include a column 24 that extends upwards from the base 18. The column 24 may be a single element, or, as shown in FIG. 1, it may include a pneumatic cylinder 26 to permit height adjustment of the chair 10, as is known in the art.

Figure 3:
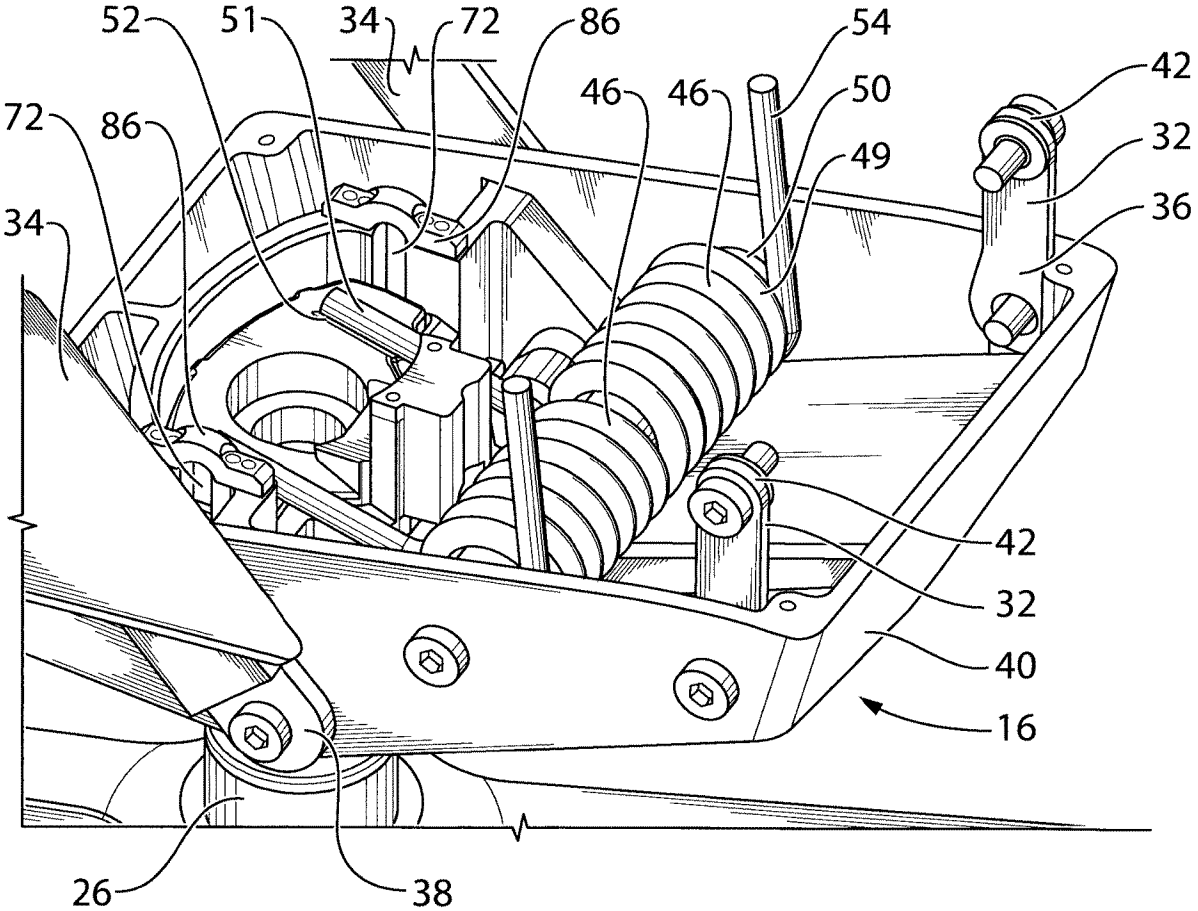
FIG. 3 is a perspective view of a portion of the chair shown in FIG. 1.

The body support assembly 14 supports the body of a user on the chair 10, and may include a seat member 28 and a backrest 30. In the embodiment shown, first and second pivot links 32 and 34 (which may also be referred to as front and rear pivot links 32 and 34) connect the body support assembly 14 to the tilt control assembly 16 forming a four-bar linkage between them. As shown in FIG. 3 (which shows the tilt control assembly 16 with the seat 28 removed from the view), it can be seen that there are two first pivot links 32 and two second pivot links 34. Any other suitable number of first and second pivot links 32 and 34 is alternatively possible, however, such as one first pivot link 32 and one second pivot link 34, or three or more of each link 32 and 34. There need not be the same number of first links 32 as there are of the second links 34.

Figure 2:
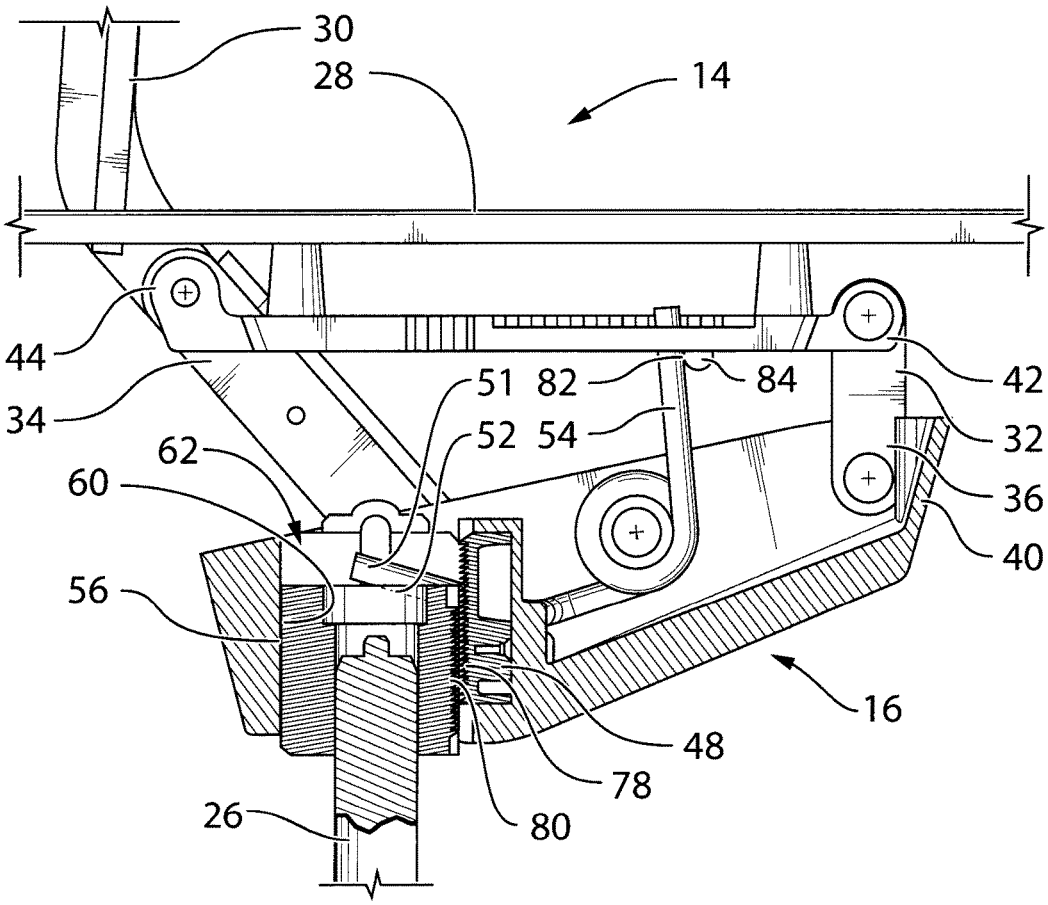
FIG. 2 is a sectional side view of a portion of the chair shown in FIG. 1, showing the chair in a rest position.

As can be seen, the pivot links 32 and 34 have first ends, shown at 36 (FIGS. 2 and 3) and 38 (FIG. 1) respectively which are pivotally mounted to a housing 40 that is part of the tilt control assembly 16. Referring to FIG. 2, the second ends of the links 32 and 34, shown at 42 and 44 respectively, of the pivot links 32 and 34 are both pivotally mounted to a front end and rear end respectively of the seat member 28.

The rear pivot link 34 has a selected length to cause the rear end of the seat support member 28 to drop in height at a selected rate compared to the front end of the seat support member 28, thereby providing the seat support member 28 with a selected rate of rotation during reclining of the body support assembly 14.

The backrest 30, however, is connected fixedly to the second links 34, and is not connected to the first links 32. As a result of the connections between the pivot links 32 and 34 to the seat support member 28 and the backrest 30, the seat support member 28 and the backrest 30 recline at different rates relative to each other. In an embodiment, the backrest 30 reclines at approximately twice the angular rate of the seat member 28.

The tilt control assembly 16 controls the reclining of the body support assembly 14, away from an unreclined position shown in FIG. 1 relative to the pedestal 12. As shown in FIGS. 2 and 3, the tilt control assembly 16 may include the housing 40, first and second backrest biasing members 46 and an optional locking member 48. It will be noted that there need not be two backrest biasing members 46. There could be one backrest biasing member 46, or three or more backrest biasing members 46.

The backrest biasing members 46 are mounted to the housing 40 and urge the backrest 30 towards an unreclined position, which is the backrest position shown in FIGS. 1-6.

As shown in FIG. 2, the backrest biasing members 46 may be torsion springs that have coils 49 that are captured on a coil mounting bar 50 that forms part of the housing 40. The backrest biasing members 46 have first ends 51 that engage a first end abutment surface 52 that is on the pedestal 12, as shown in FIGS. 2 and 3. The backrest biasing members 46 have second ends 54 that are positioned to urge the body support assembly 14 towards the unreclined position. For example, as shown in FIG. 2, the backrest biasing members 46 are directly engaged with the seat 28. Alternatively, the backrest biasing members 46 could, for example, engage the first links 32, or the second links 34, or the backrest 30 to bias the body support assembly 14 towards the unreclined position.

Figure 4:
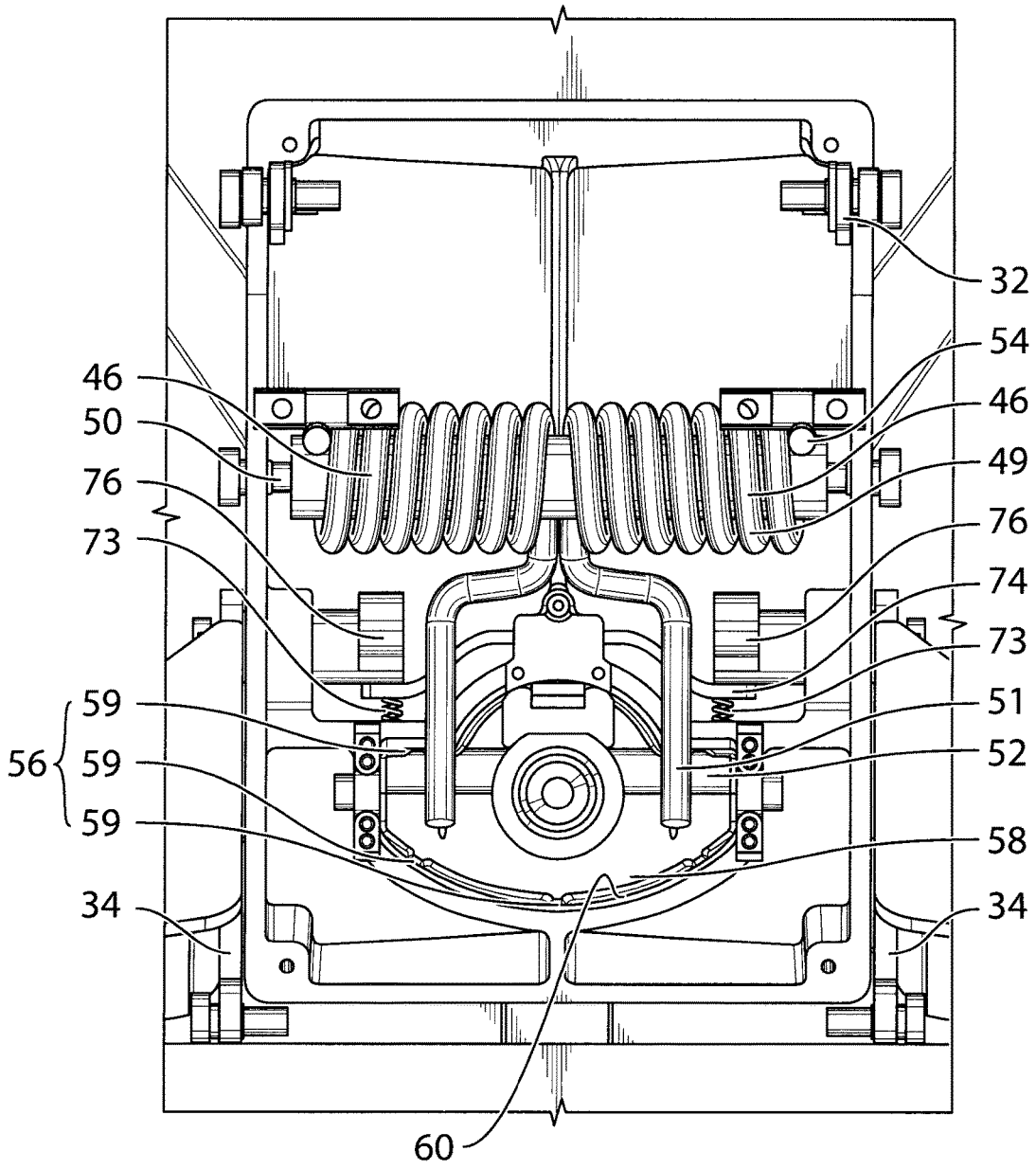
FIG. 4 is a plan view of portion of the chair shown in FIG. 1.

As can be seen in FIG. 2, the housing 40 is slidable on a pedestal guide surface 56 on the pedestal 12, in a direction that has at least some vertical component to it. The pedestal guide surface 56 may be positioned on a pedestal guide member 58 that is mounted on the column 24. As can be seen in FIG. 4 in particular, the pedestal guide surface 56 may be made up of a plurality of edge faces 59 on projections that extend outwardly on the guide member 58, so as to reduce the overall sliding contact area between the guide member 58 and the wall 60 of the aperture 62 on the housing 40 in which the pedestal guide member 58 slides. The wall 60 may be referred to as an upper assembly guide surface 60. In the embodiment shown in FIGS. 1-5, the upper assembly guide surface 60 is the wall of an aperture. However it will be understood that it is alternatively possible for the pedestal guide surface 56 to be the wall of an aperture and for the upper assembly guide surface 60 to be on a guide member that slides in the aperture.

Figure 5:
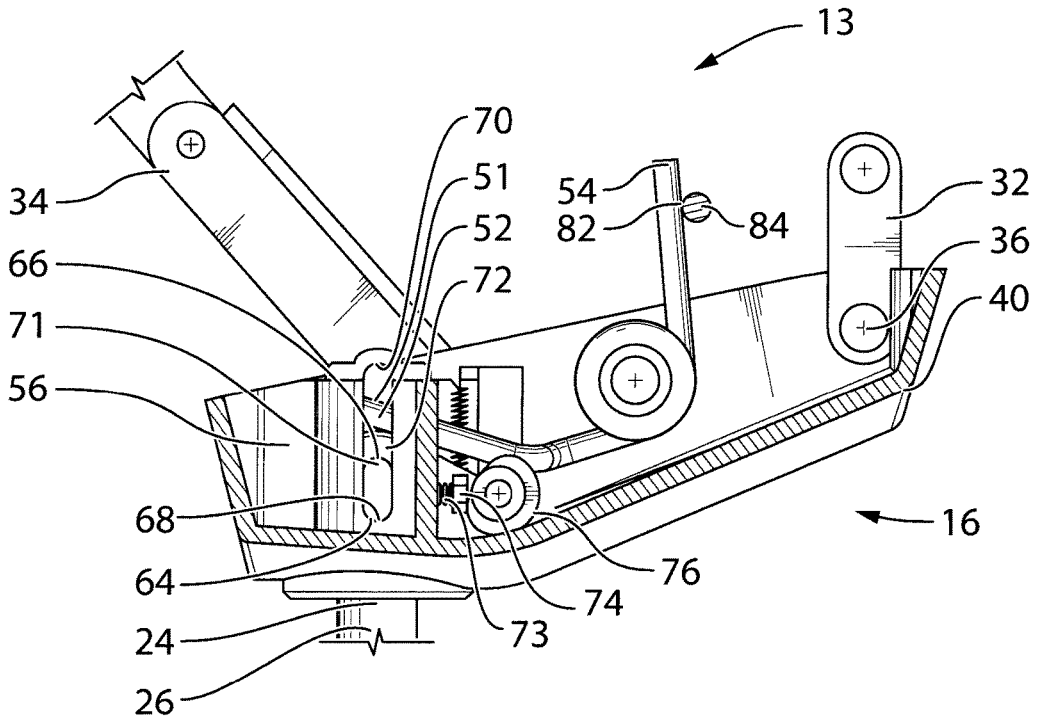
FIG. 5 is another sectional side view of a portion of the chair shown in FIG. 1, showing the chair in the rest position.

Referring to FIG. 5, the guide member 58 further has thereon first upper and lower travel limit surfaces shown at 64 and 66, which engage second upper and lower limit surfaces 68 and 70 on housing 70 (and therefore, more broadly, on the upper assembly 13). The upper and lower limit surfaces 64 and 66 and 68 and 70 serve to limit the amount of travel that is available for the upper assembly 13 relative to the pedestal 12. The upper and lower limit surface 64 and 66 may be positioned on projections 71 on the guide member 58, which slide in slots 72 in the housing 40. The upper and lower limit surfaces 68 and 70 may be end walls of the slots 72. Only one projection 71 and one slot 72 are shown in FIG. 5. The other projection 71 and slot 72 are shown in the plan view in FIG. 4. As shown in FIG. 5, the first and second upper limit surfaces 64 and 68 are engaged which means that the upper assembly 13 is at its upper limit of travel relative to the pedestal 12.

The biasing members 46 hold the upper assembly 13 at some equilibrium position on the pedestal guide surface 56 based on an equilibrium reached between any downward forces acting on the upper assembly 13 and the spring force generated by the biasing members 46. As the downward force on the upper assembly 13 increases, it causes greater flexure (in this case torsion) in the biasing members 46 which increases the spring force generated by the biasing members 46 based on a spring rate of the biasing members 46, until a new equilibrium position is reached.

The equilibrium position shown in FIGS. 1-5 is the position reached based only on the weight of the upper assembly 13 alone, and may be referred to as a rest position. In the rest position, the biasing members 46 have some initial, non-zero, amount of preload, based on the weight of the upper assembly 13.

Figure 6:
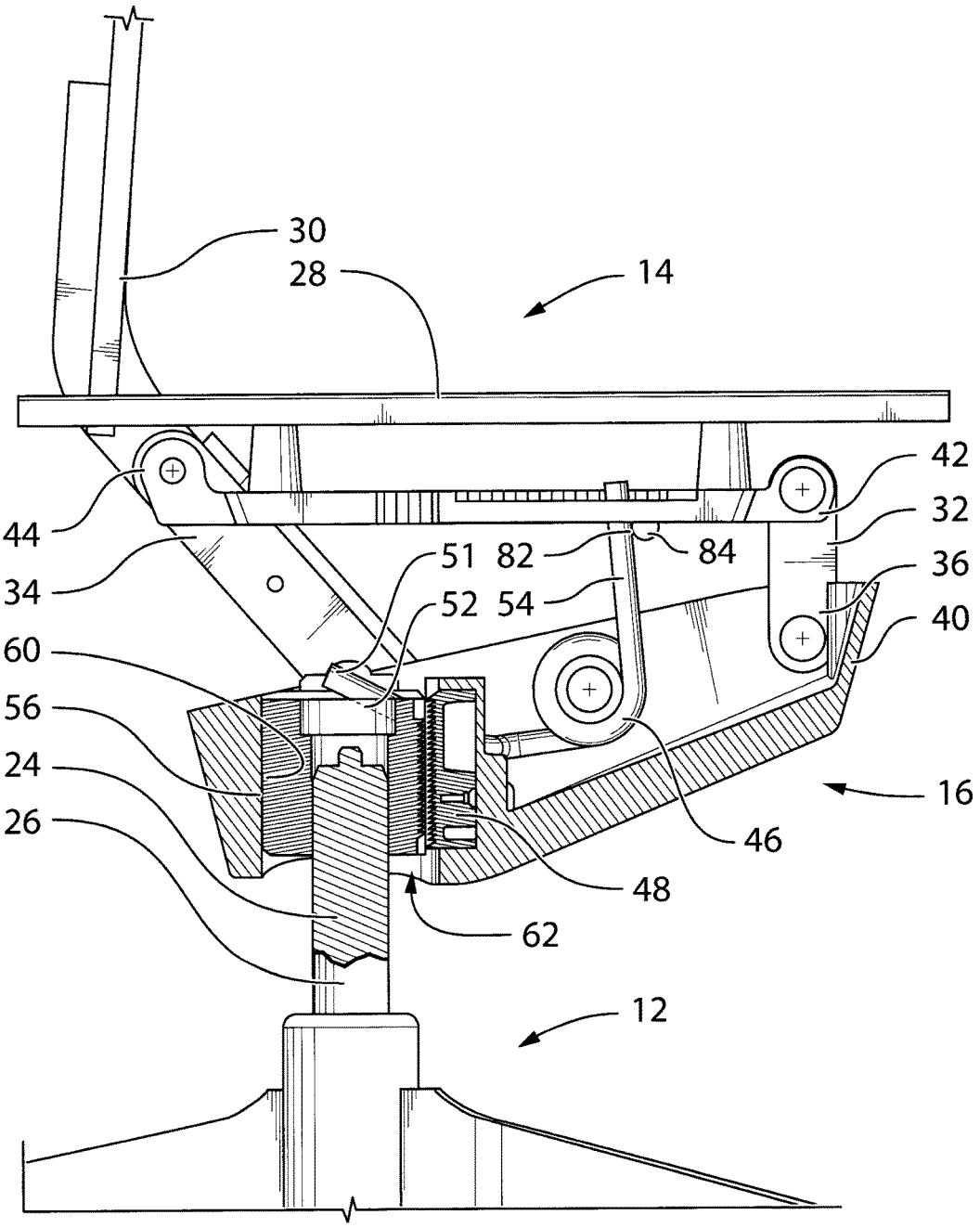
FIG. 6 is a sectional side view of a portion of the chair shown in FIG. 1, showing the chair in a weight-adjusted preloaded and unreclined position.

Reference is made to FIG. 6, which shows the chair 10 in a state when a person (not shown) sits on it but has not yet reclined in it. When a person sits on the chair 10 the downward force on the upper assembly 13 increases and as a result, the upper assembly 13 slides downwardly on the guide member 58, which flexes the biasing members 46 and increases the amount of preload that exists in the biasing members 46 until a new equilibrium position is reached where the spring force in the biasing members 46 matches the downward force generated by the person sitting in the chair 10 and the weight of the upper assembly 13 itself.

The equilibrium position shown in FIG. 6 may be referred to as the weight-adjusted preload position. As noted above, the body support assembly 14 is in the unreclined position in FIG. 6.

Figure 7:
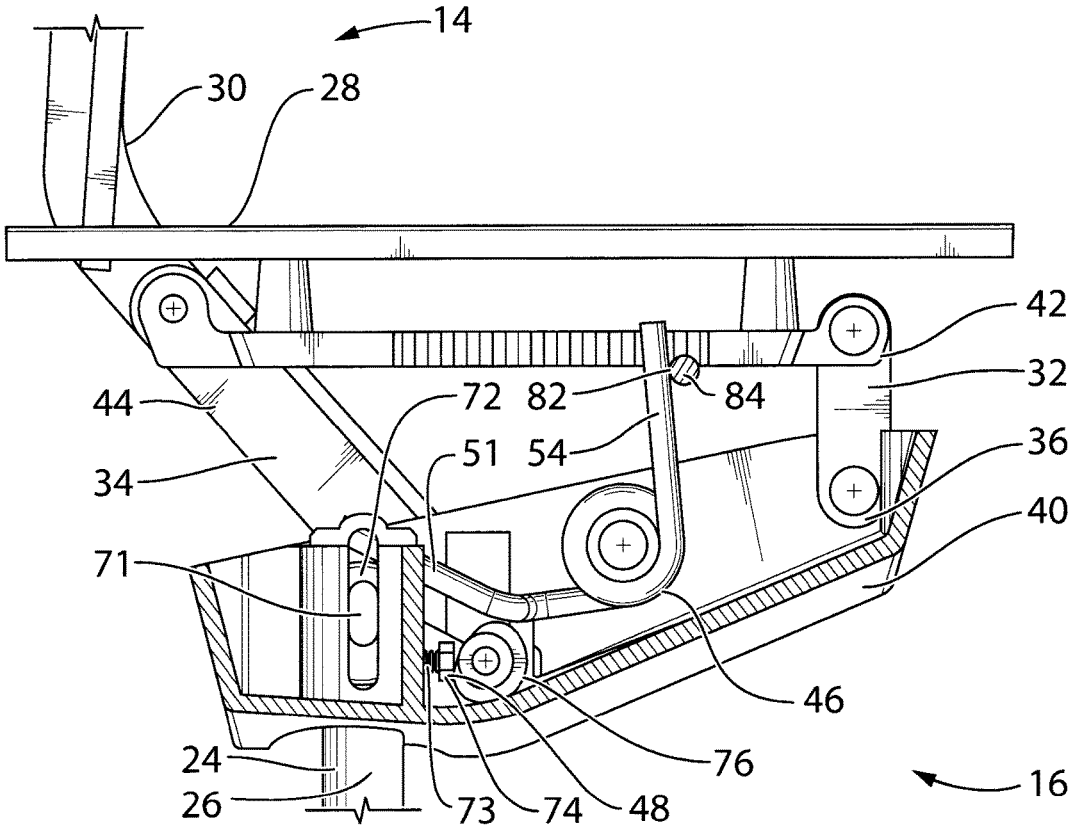
FIG. 7 another sectional side view of a portion of the chair shown in FIG. 1, showing the chair in the weight-adjusted preloaded and unreclined position.

FIG. 7 shows the position of the projection 71 in the slot 72 for the chair 10 in the weight-adjusted preload position.

Figure 8:
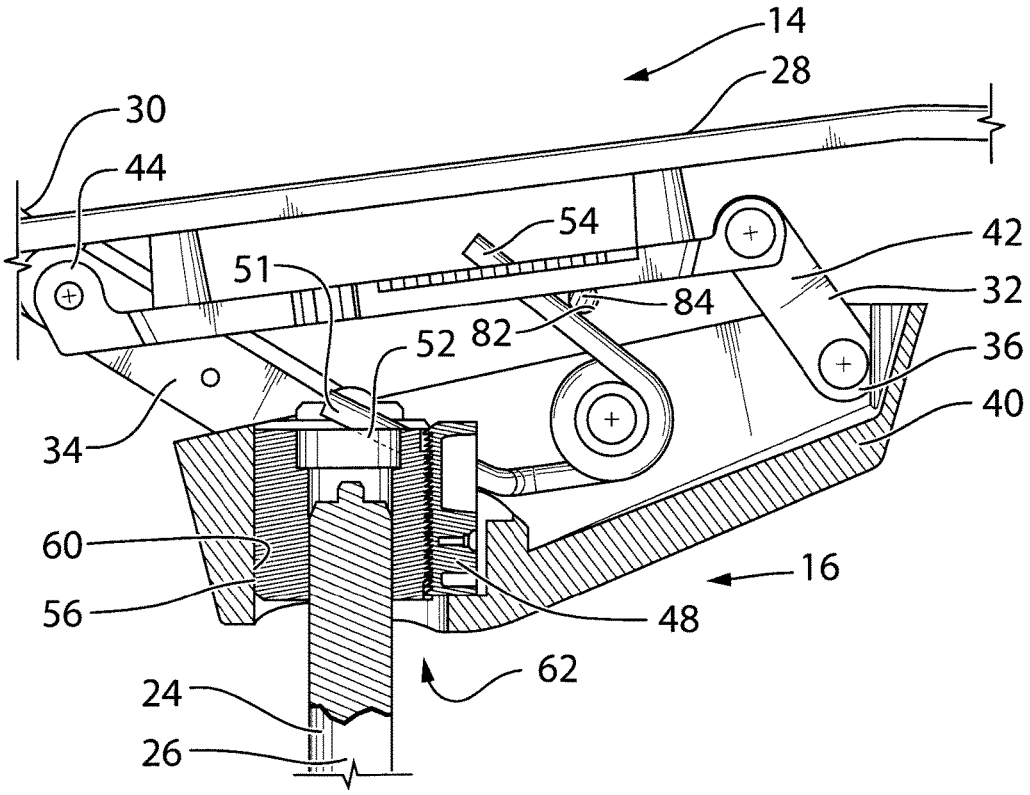
FIG. 8 is a sectional side view of a portion of the chair shown in FIG. 1, showing the chair in a reclined and locked position.

Reference is made to FIG. 8, which shows the body support assembly 14 in a reclined position. Only a small portion of the backrest 30 is visible in FIG. 8 so as to permit the tilt control assembly 16 to be shown at a large size in the figure. As the user urges the backrest 30 to recline, the biasing members 46 provide a resistive force to the backrest 30, through the seat support member 28, and in turn through the pivot links 32 and 34 (the pivot link 34 in particular). The resistive force applied to the backrest 30 by the biasing members 46 is based on the preload in the biasing members 46, which depends on the weight of the user sitting on the chair 10 as explained above in relation to FIG. 6. Thus, the resistance of the backrest 30 to reclining is higher for a relatively heavier user than it is for a relatively lighter user. This is advantageous over chairs that do not modify the biasing force on the backrest to account for the weight of the user. Such prior art chairs can sometimes apply a resistive force that is too strong for lightweight users making them difficult for a lightweight user to recline in, or can sometimes apply a resistive force that is too weak for heavier users making it difficult for a heavy user to recline in without inadvertently reclining farther than intended, sometimes with unsafe results.

It will be noted that the biasing members 46 serve the purpose of biasing the upper assembly 13 toward the rest position (i.e. biasing the chair 10 towards the rest position), and also serve the purpose of biasing the body support assembly 14 towards the unreclined position, with a force that is based on the weight of the user. It is advantageous to be able to provide this combination of features using one set of biasing members (i.e. biasing members 46).

However, the tilt control assembly 16 described herein, in at least some embodiments, has relatively few components, thereby making it relatively reliable and relatively inexpensive to produce.

The locking member 48 will now be described in further detail. When the user sits in the chair 10 initially thereby increasing the preload in the biasing members 46, the body support assembly 14 is unreclined and the locking member 48 is in an unlocked position. In the unlocked position, the locking member 48 permits relative movement between the housing 40 (and thus the upper assembly 13) and the pedestal 12. Thus, the locking member 48 permits the user to sit in the chair 10 and increase the preload in the chair 10 while the body support assembly 14 is in the unreclined position. The locking member 48 may be biased toward the unlocked position, by one or more locking member biasing members shown at 73 in FIG. 4 which apply a biasing force to an arm 74 that is part of the locking member 48.

Figure 9:
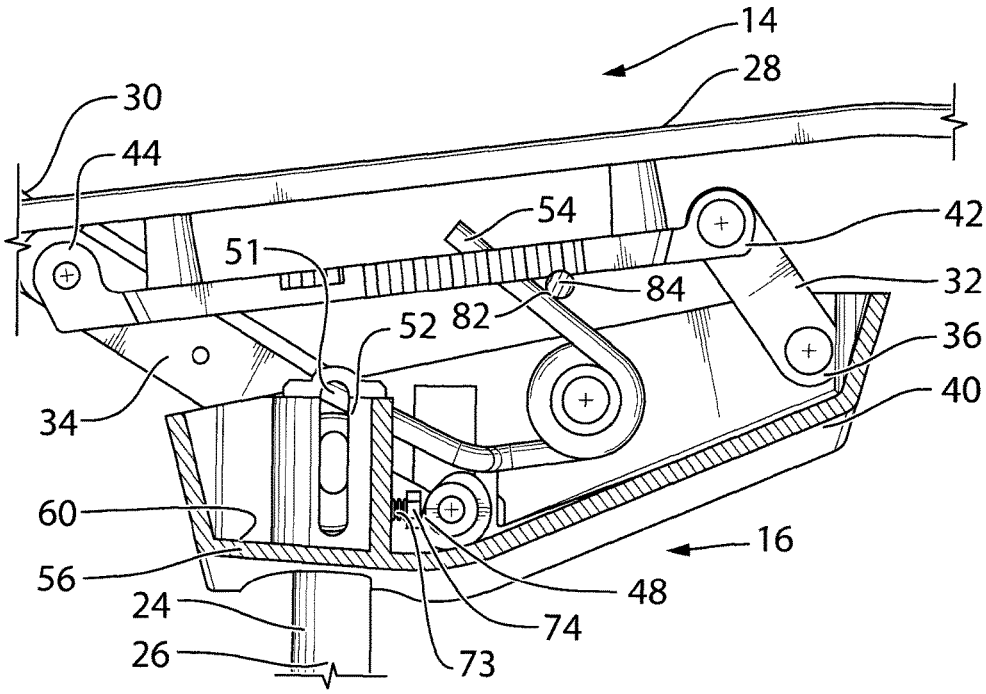
FIG. 9 is another sectional side view of a portion of the chair shown in FIG. 1, showing the chair in the reclined and locked position.

Referring to FIG. 4, a locking member drive cam 76 is connected to each of the arms 34 so that as the arms 34 rotate, the cams 76 rotate (i.e. the cams 76 co-rotate with the arms 34). As shown in FIGS. 5 and 7, when the body support assembly 14 is in the unreclined position, the cams 76 are positioned in an unlocked position wherein the cams 76 permit the locking member 48 to be in the unlocked position. However, the body support assembly 14 is operatively connected to the cams 76 such that when the user reclines the body support assembly 14, as shown in FIG. 9, the cams 76 are rotated and drive the locking member 48 (by driving the arm 74) to a locking position (as can be seen in FIG. 8. In the locking position, first teeth 78 on the locking member 48 engage second teeth 80 on the pedestal 12 (on the guide member 58) thereby locking the housing 40 (and therefore the upper assembly 13 vertically relative to the pedestal 12. This reduces the tendency of the upper assembly 13 to 'float' on the pedestal 12 as the user shifts their weight, while reclined. By way of the cams 76, the body support assembly 14 may be said to be operatively connected to the locking member 48.

The locking member 48 with the teeth 78 thereon, the locking member biasing members 73, the cams 76 and the teeth 80 on the pedestal 12 together form a locking mechanism.

The locking mechanism does not restrict the user from changing the angle of recline of the body support assembly 14. The user may change the angle as much or as little as desired. When the user removes the force urging the backrest 30 rearwardly, the biasing members 46 urge the body support assembly 14 towards the unreclined position. As the body support assembly 14 reaches the unreclined position, the cams 76 no longer drive the locking member 48 towards the locking position and so the locking member biasing members 73 urge the locking member 48 towards the unlocked position, thereby bringing the teeth 78 out of engagement with the teeth 80. At this point, the upper assembly 13 can move vertically relative to the pedestal 12.

While a plurality of teeth 78 and a plurality of teeth 80 are shown, it is possible for the locking mechanism to include as few as one tooth 78 and a plurality of teeth 80, or as few as one tooth 80 and a plurality of teeth 78, while still providing a plurality of relative positions at which the housing 40 can be locked vertically relative to the pedestal 12. In another embodiment a single tooth 78 and a single tooth 80 could be provided, which would releasably prevent the housing 40 from rising above a certain position relative to the pedestal 12 once the housing 40 was pushed downwardly below that particular position and the body support assembly 14 was reclined.

An additional feature of the embodiment shown in FIGS. 1-9 is that the biasing members 46 mount into position with relatively little effort. For example, the first ends 51 of the biasing members 46 do not need to be guided into apertures in the guide member 58. Instead the first ends 51 simply sit atop a surface (i.e. the first end abutment surface 52) with no restriction above the first ends 51. Thus, the biasing members 46 can be easily mounted into the housing 40 without having to align the first ends 51 with any apertures while at the same time aligning other portions of the biasing members 46 with other apertures. In other words, the number of elements of the biasing members 46 that must align with other portions of the chair 10 during installation of the biasing members 46 is reduced as compared to certain chairs 10 of the prior art, or at least is reduced as compared to an arrangement in which the first ends 51 would have to align with apertures in the guide member 58. In some embodiments, this relationship between the first ends 51 and the first end abutment surface 52 would permit the housing 40 with the biasing members 46 already installed to simply be lowered onto the pedestal 12 such that the guide member 58 would slide upwards into the aperture 62 to engage the first ends 51. In such embodiments, the slots 72, if provided, may be configured to receive the projections 71 through an open end at the bottom such that the open end could be closed by an end member, similar to the end members 81 shown at the top ends of the slots 72 in the embodiment shown in FIG. 2.

The second ends of the springs 54 engage a second end abutment surface 82 that is on a second end abutment member 84 that mounts to the seat support member 28. Optionally the second end abutment member 84 is mountable in a plurality of positions (i.e. is adjustable in position) on the seat support member 28 which permits the preload in the biasing members 46 to be adjusted.

Figure 19:
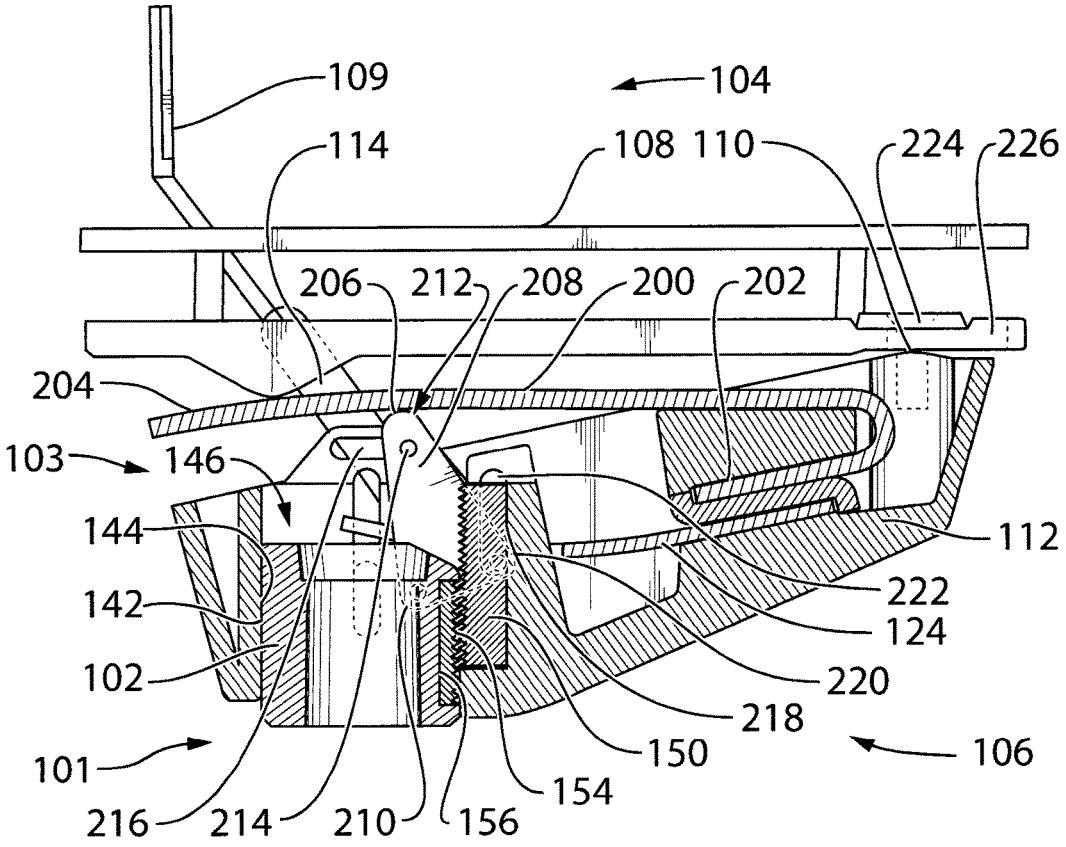
FIG. 19 is a sectional view of a variant of the portion of the chair shown in FIG. 12, in a rest position.
Figure 20:
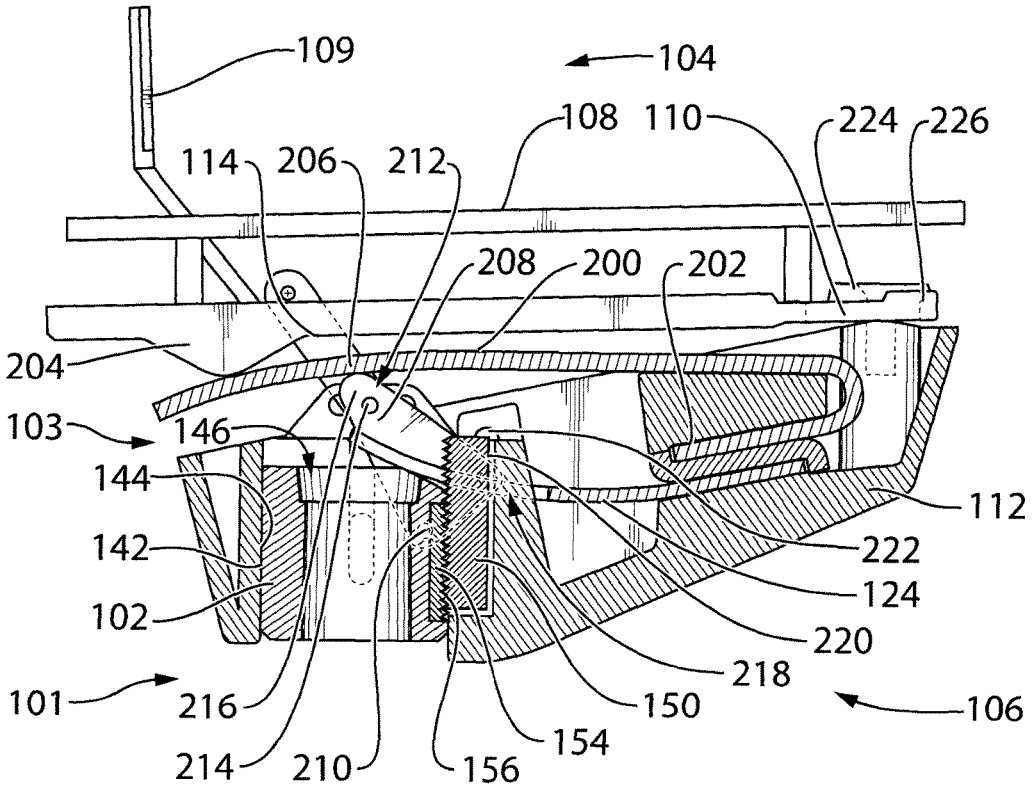
FIG. 20 is a sectional view of the variant of the portion of the chair shown in FIG. 12, in a reclined and locked position.

As can be seen by the above description, the biasing members 46 provide several functions. For example, the biasing members 46 provide a resistive force to a user sitting on the chair 10 and bias the upper assembly 13 towards a rest position on the pedestal 12. Additionally, the biasing members 46 provide a resistive force to a user reclining the body support assembly 14 and bias the backrest 30 (and indeed the body support assembly 14) towards an unreclined position. Thus, the bising members 46 may be considered to be both upper assembly biasing members and body support assembly biasing members. Instead of providing one or more biasing members (such as biasing members 46) that perform both these functions, it is optionally possible to provide one or more first biasing members for resisting the weight of the sitting user, and one or more second biasing members that resist the user reclining in the chair 10, an example of which is shown in FIGS. 12-18 and another example of which is shown in FIGS. 19-20.

Figure 10:
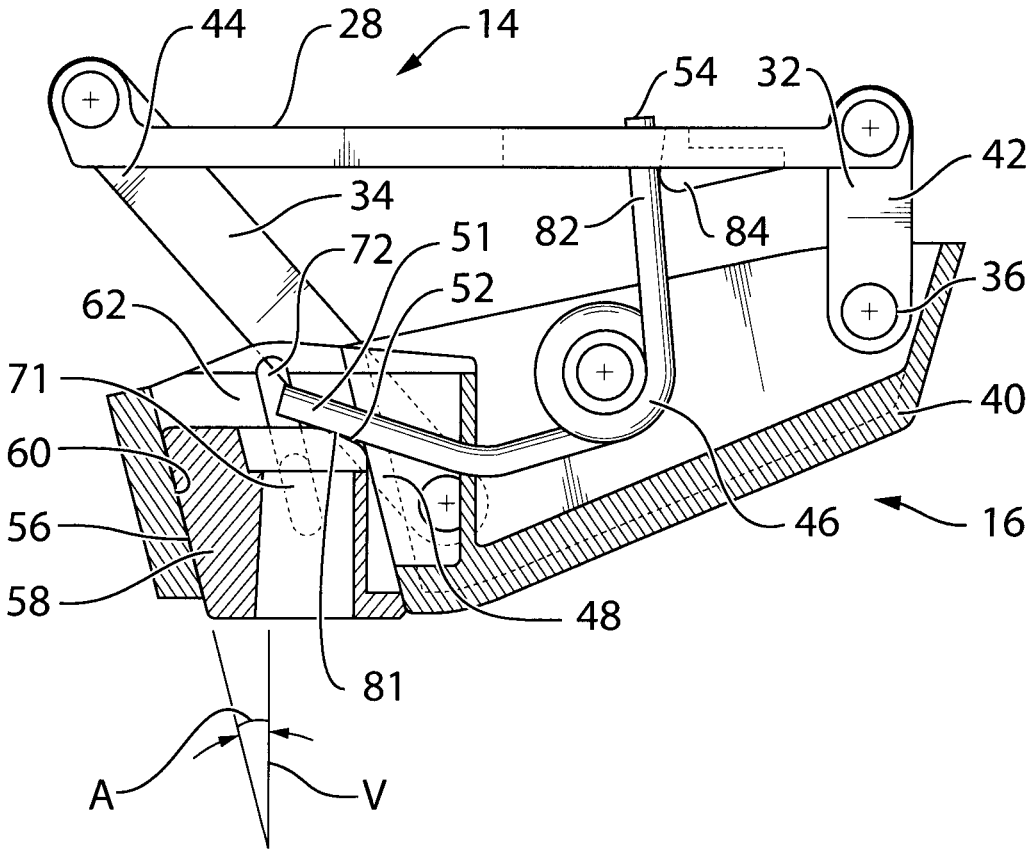
FIG. 10 is a sectional view of a variant of the chair shown in FIG. 1, in a rest position.
Figure 11:
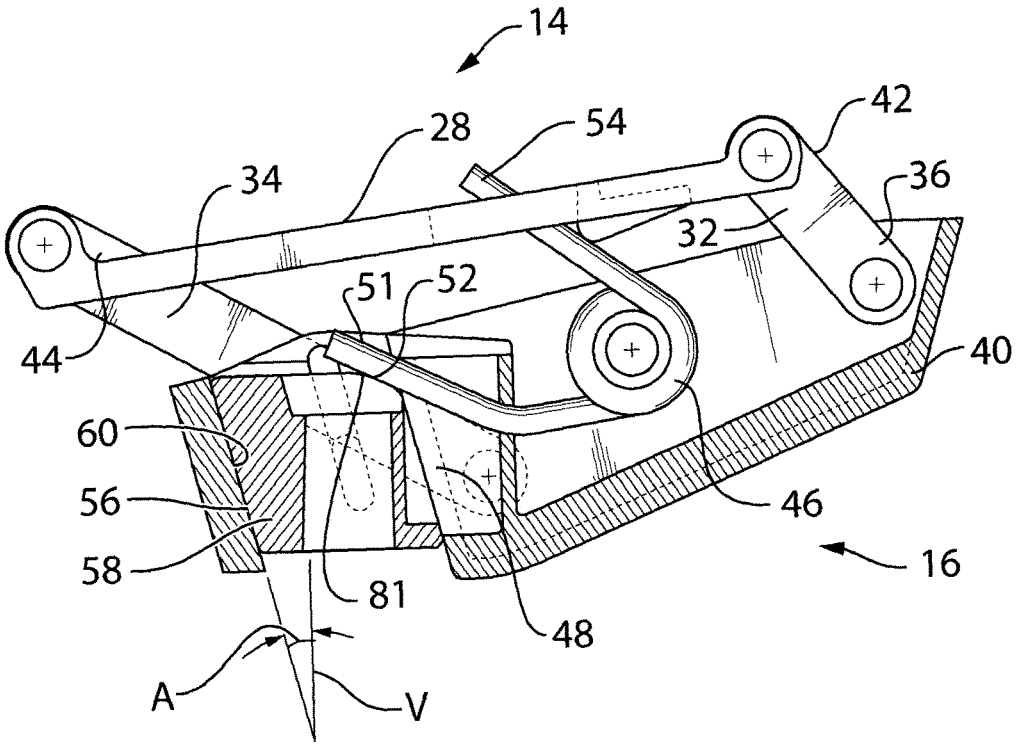
FIG. 11 is a sectional view of the variant of the chair shown in FIG. 10, in a reclined and locked position.

Reference is made to FIGS. 10 and 11, which show a sectional view of a variant of the chair 10. In this variant, the guide member 58 and the aperture 62 in the housing 40 are configured to guide the movement of the upper assembly 13 on the pedestal 12 along a path that is at some selected angle with respect to vertical (a vertical axis is shown at V in FIG. 10). The selected angle is shown at A in FIG. 11, and in the embodiment shown in FIGS. 10 and 11, it is 15 degrees. The particular point of contact between the biasing member 46 and the first end abutment surface 52 is shown at 81 in FIGS. 10 and 11. As the guide member 58 moves upwards relative to the housing 40 under the weight of a seated user, it will be noted that the point of contact 81 shifts along the first end 51 of the biasing member as a result of the selected angle of the path along which the guide member 58 travels. This permits a person developing the chair 10 for manufacture to control and adjust the amount of preload that is imparted to the biasing member 46 through movement of the guide member 58 and thereby permits control of the relationship between the weight of the user and the amount of preload that is provided by the biasing member 46. While a selected angle of 15 degrees for the path is shown in FIGS. 10 and 11, the selected angle A may be some other angle, such as, for example, an angle in the range of about 15 degrees to about 20 degrees. The selected angle A may be selected so that the desired preload is imparted to the biasing member 46, while taking care to ensure that the guide member 58 can move in the aperture 62 without a prohibitive amount of friction between the guide member 58 and the aperture wall 60.

FIG. 10 shows the chair 10 in the rest position. FIG. 11 shows the chair 10 in the weight-adjusted preloaded and reclined position. FIG. 11 also shows the chair 10 in the rest position.

Figure 12:
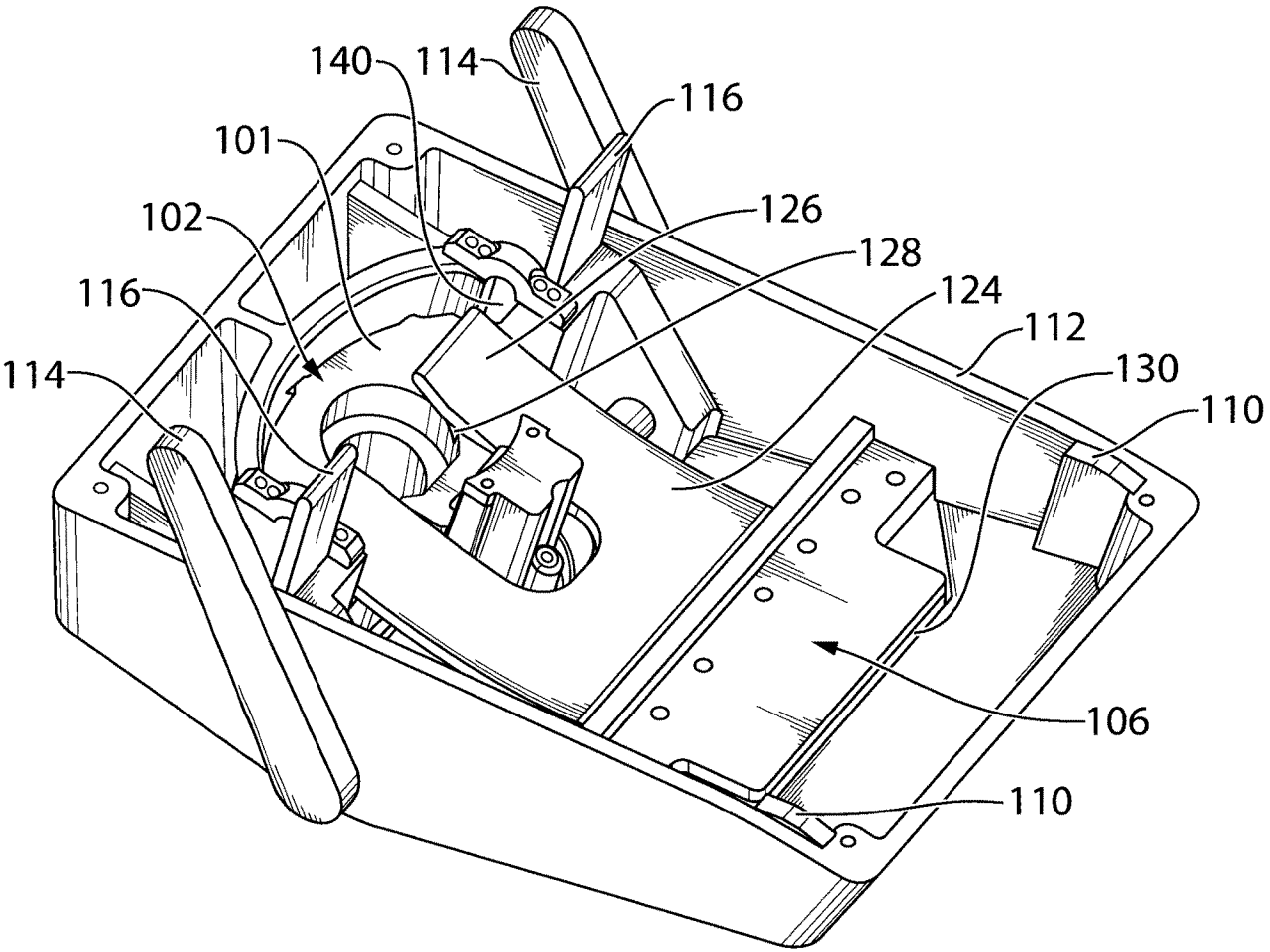
FIG. 12 is a perspective view of a portion of a chair in accordance with another embodiment of the present invention.
Figure 13:
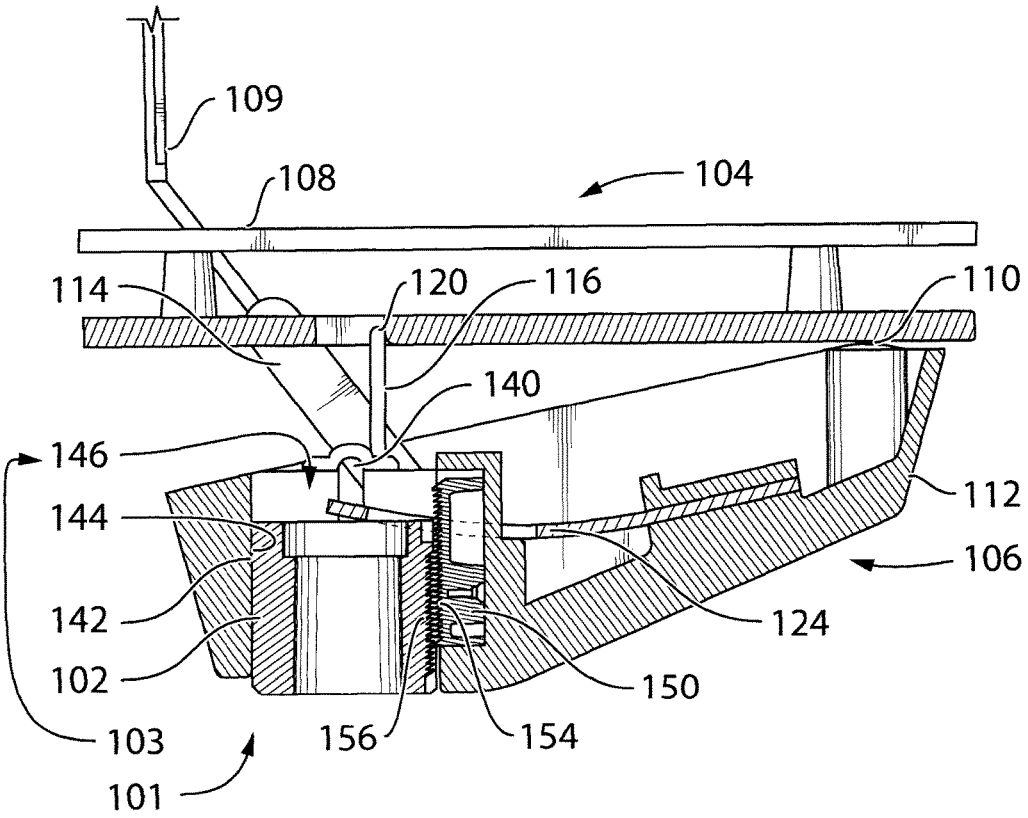
FIG. 13 is a sectional side view of the portion of the chair shown in FIG. 12, in a rest position.
Figure 14:
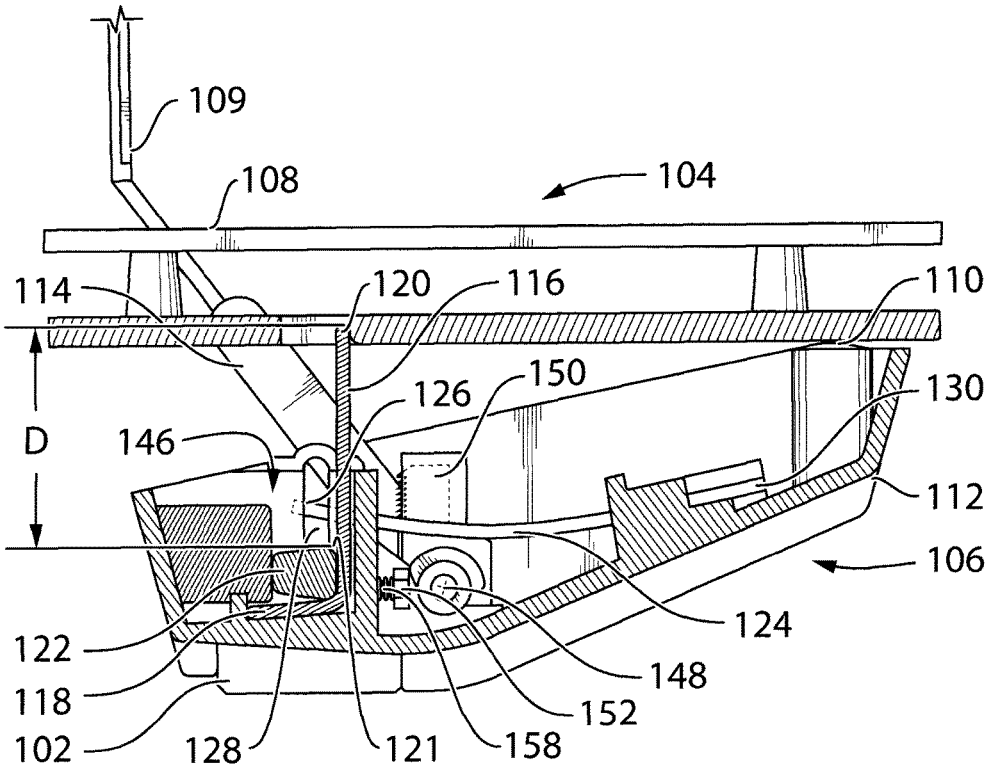
FIG. 14 is another sectional side view of a portion of the chair shown in FIG. 1, in the rest position.

FIG. 12 shows a chair 100 in accordance with another embodiment of the present invention. The chair 100 includes a pedestal 101, which includes guide member 102, and which may otherwise be similar to the pedestal 12 shown in FIG. 1. The chair 100 further includes an upper assembly 103 (FIG. 13) which includes a body support assembly 104, and a tilt control assembly 106. The body support assembly 104 includes a seat support member 108 and a backrest 109. Instead of connecting the seat support member 108 to front and rear pivot links, the front portion of the seat support member 108 slides on a slide surface 110 that is on a housing 112 that is part of the tilt control assembly 106, while the rear portion of the seat support member 108 is pivotally connected to a rear pivot link, shown at 114. The rear pivot link 114 may have the backrest 109 fixedly connected to it, in similar manner to the rear pivot link 34 in the embodiment shown in FIGS. 1-9.

During reclining of the body support assembly 104, there is a selected relationship between the rate of change of angle of the seat support member 108 and the rate of rotation of the backrest 109. The relationship may be any suitable relationship. For example, the relationship may be that the angle of the backrest 109 changes twice as fast as the angle of the seat support member 108. The body support assembly 104 is shown in the reclined position in FIGS. 17 and 18.

The body support assembly 104 is biased towards the unreclined position shown in FIGS. 12-16 by a pair of body support assembly biasing members 116. The body support assembly biasing members 116 may be leaf springs each having a first end 118 (FIG. 14) that is captured by the housing 112 and a second end 120 that is engaged with the seat support member 108. While the body support assembly biasing members 116 have been shown to be leaf spring, it could be another type of spring. While two biasing members 116 are shown there could be as few as one biasing member 116 or three or more biasing members 116.

When the body support assembly 104 is in the unreclined position, as shown in FIGS. 12-16, there may be no preload in the body support assembly biasing members 116. As the body support assembly 104 is reclined by a user, the reclining movement of the seat support member 108 drives the second end 120 of the body support assembly biasing member 116 rearwardly thereby causing the spring 116 to bend about a bending surface 121 that is on a projection 122 on the guide member 102. Although obscured from view in FIGS. 12-18, there are two bending surfaces 121 and two projections 122—one bending surface 121 for each body support assembly biasing member 116. It will be understood, however, that there could alternatively be only one bending surface 121 (or three or more bending surfaces 121) regardless of how many projections 122 there are. Alternatively there could be one projection 122 or three or more projections 122 regardless of how many bending surfaces 121 there are.

Figure 16:
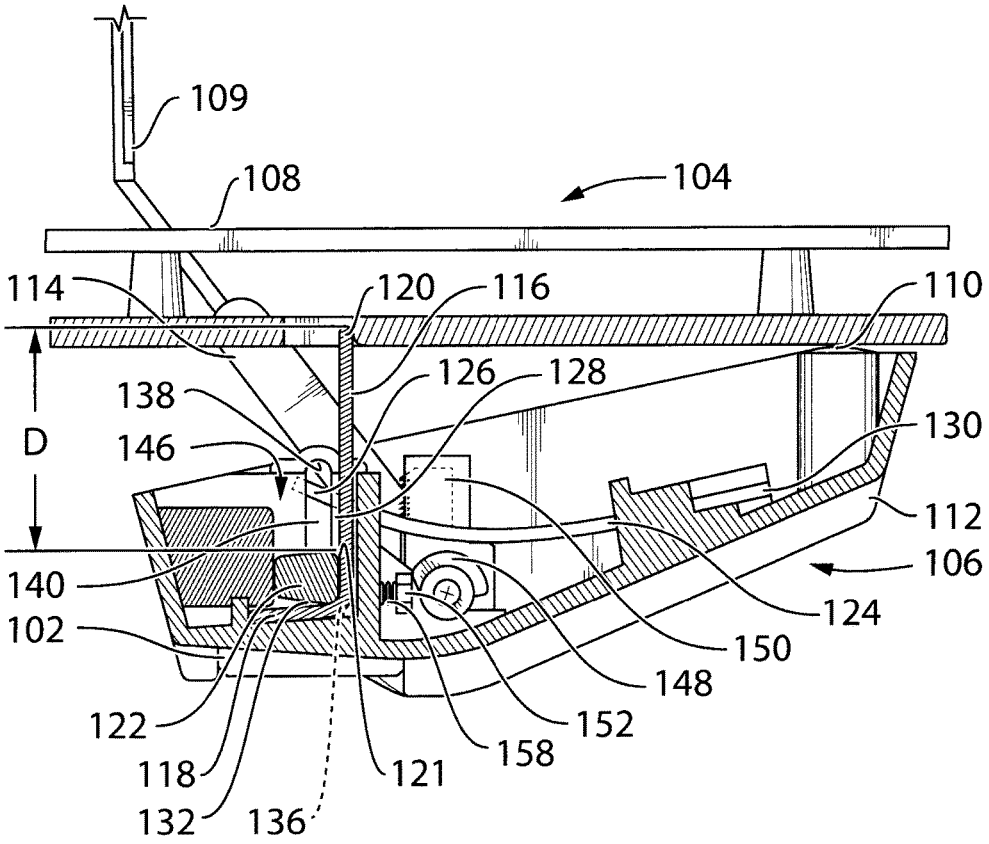
FIG. 16 another sectional side view of the portion of the chair shown in FIG. 12, in the weight-adjusted preloaded and unreclined position.

Referring to FIG. 16, each projection 122 (and thus the guide member 102) may further include first upper and lower travel limit surfaces shown at 132 and 134, which engage second upper and lower limit surfaces 136 and 138 on housing 70 (and therefore, more broadly, on the upper assembly 13). The upper and lower limit surfaces 132 and 134 and 136 and 138 serve to limit the amount of travel that is available for the upper assembly 103 relative to the pedestal 101. The second upper and lower limit surfaces 136 and 138 may be end walls of the slots shown at 140.

The force with which the biasing members 116 resist the bending force exerted by the seat support member 108 depends in part on the moment arm of the bending force, which is the distance between the point through which the seat support member 108 exerts the bending force on the biasing members 116 and the point about which the biasing members 116 bend, and in part on how far the biasing members 116 have been bent. The moment arm is shown at D in FIG. 14. It will be understood that, as the distance D increases, the resistive force of the biasing members 116 (i.e. the biasing force of the biasing members 116) decreases, and as the distance D decreases, the resistive force of the biasing members 116 increases.

The tilt control assembly 106 further includes an upper assembly biasing member 124. The upper assembly biasing member 124 is mounted to the housing 112, and has a first end 126 that engages a first end abutment surface 128 on the guide member 102. The second end of the upper assembly biasing member 124 is shown at 130 and is mounted to the housing 112. The upper assembly biasing member 124 biases the upper assembly 103 towards the rest position shown in FIGS. 13 and 14. The upper assembly biasing member 124 may be a leaf spring as shown in FIGS. 12-18, or alternatively it may be some other kind of biasing member, such as another kind of spring.

Figure 15:
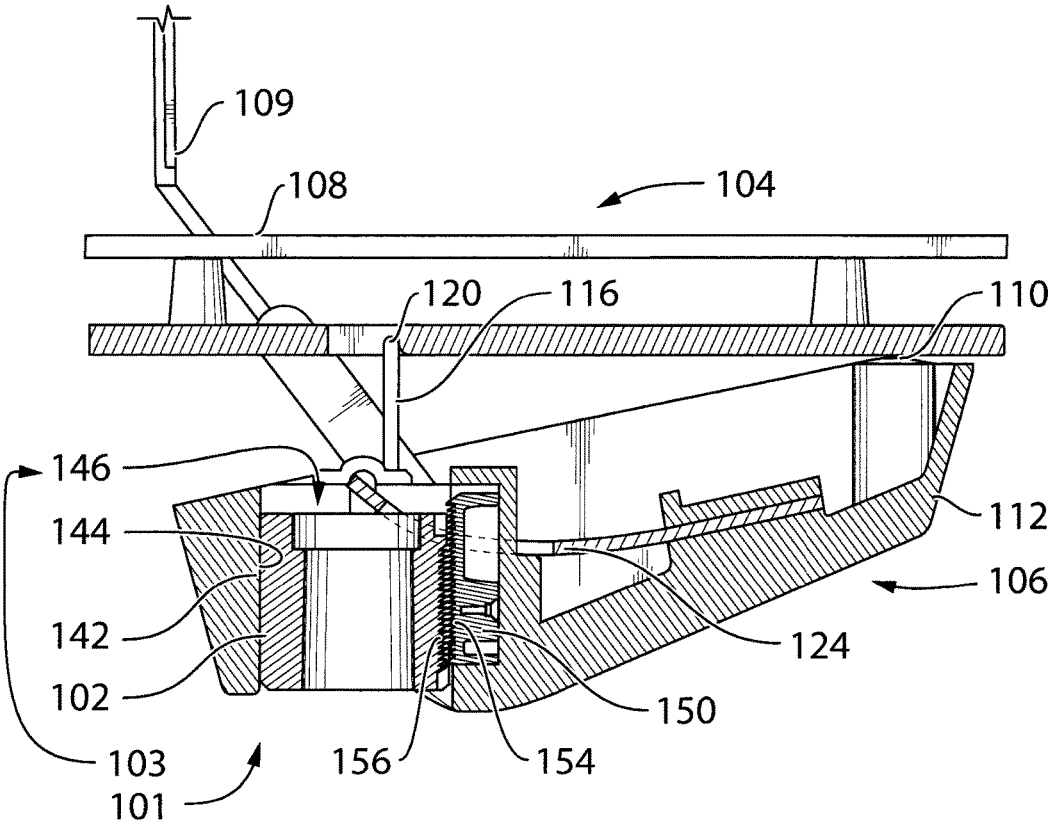
FIG. 15 is a sectional side view of the portion of the chair shown in FIG. 12, in a weight-adjusted preloaded and unreclined position.

When a user sits in the chair 100 the weight of the user causes the upper assembly 103 to slide downwards relative to the pedestal 101 (which guide surface 142 on guide member 102 engaging aperture wall 144 of aperture 146 in the housing 112, and specifically relative to the first end abutment surface 128. This causes progressively increasing flexure of the upper assembly biasing member 124, which increases the biasing force in the biasing member 124 until an equilibrium position is reached at which point the biasing force of the biasing member 124 supports the weight of the user. An example of an equilibrium position is shown in FIGS. 15 and 16. As shown in FIG. 16 in particular, the movement of the upper assembly 103 relative to the pedestal 101 has caused a change in the position of the projections 122 and therefore the bending surfaces 121. Thus, the moment arm D has changed. It will be noted that as the moment arm D is reduced, it becomes more difficult to bend the biasing members by any given distance. In other words, as the moment arm D is reduced, the spring rate of the biasing members 124 increases. In the embodiment shown in FIGS. 12-18, the moment arm D is reduced as the weight of the user increases. Thus, as the weight of the user increases, the spring rate of the biasing members 124 increases.

Thus, in the embodiment shown in FIGS. 12-18, the chair 100 is configured to compensate for the weight of the user by changing the spring rate of the body support assembly biasing members 116 instead of changing the amount of preload in them.

Figure 17:
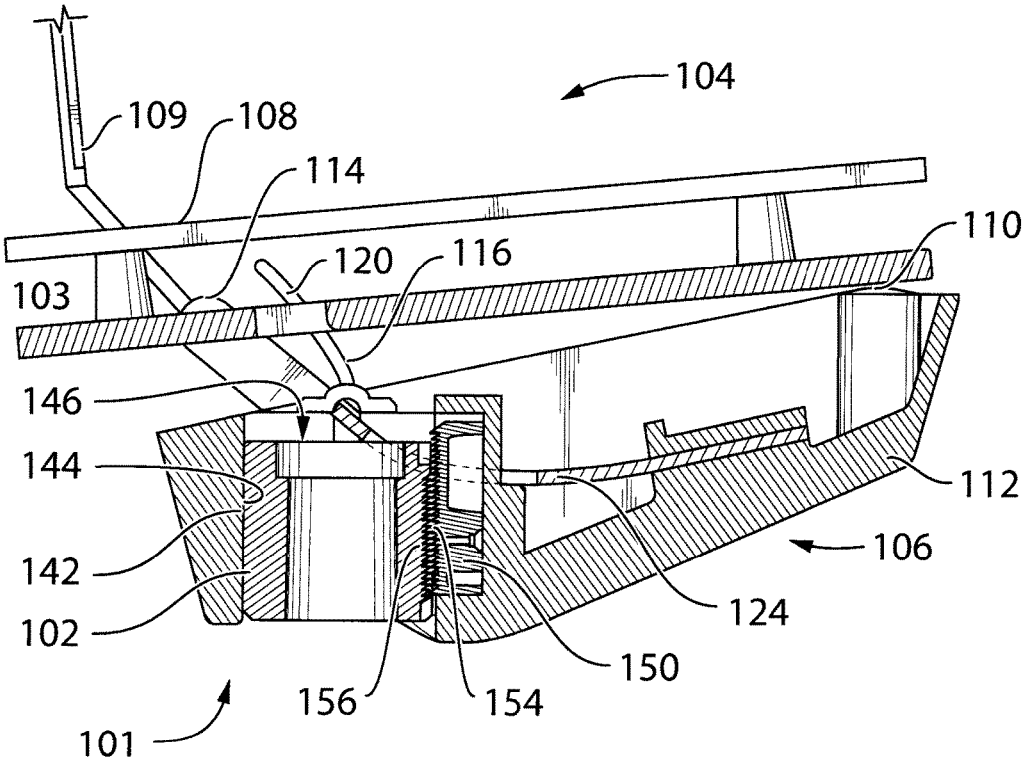
FIG. 17 is a sectional side view of the portion of the chair shown in FIG. 12, in a reclined and locked position.
Figure 18:
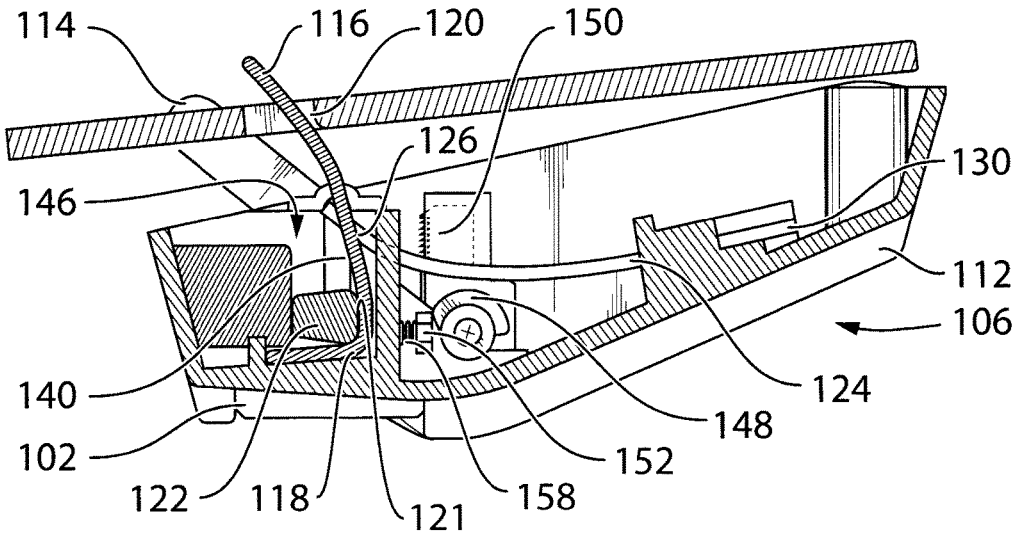
FIG. 18 is another sectional side view of the portion of the chair shown in FIG. 12, in the reclined and locked position.

FIGS. 17 and 18 show the chair 100 in a reclined position, (i.e. with the body support assembly 104 in a reclined position). In similar manner to the locking mechanism shown in FIGS. 1-9, the rear pivot links 114 have cams 148 (FIGS. 16 and 18) thereon which drive a locking member 150 (FIGS. 15 and 17) rearwardly by engaging locking member arms 152 (FIGS. 16 and 18) extending therefrom when the rear pivot links 114 rotate as a user reclines from an unreclined position shown in FIGS. 15 and 16 to a reclined position shown in FIGS. 17 and 18. The locking member 150 may have one or more teeth 154 which engage one or more teeth 156 on the pedestal 101 when the locking member 150 is in the locking position. The locking member biasing members that bias the locking member 150 towards the unlocked position are shown at 158.

While the front end of the seat support member 108 is shown in the embodiment of FIGS. 12-18 to slide on the slide surface 110 during reclining it is alternatively possible to provide a pivot link similar to pivot link 32 (FIG. 1) in place of the slide surface. Conversely, the embodiment shown in FIGS. 1-9 may employ a slide surface similar to slide surface 110 shown in FIG. 12 instead of the front pivot link 32.

Reference is made to FIGS. 19 and 20 which show a variant of the chair 100, wherein the body support assembly biasing member (shown at 200) is a leaf spring that is generally horizontally oriented instead of the generally vertically oriented leaf spring that is each of the body support assembly biasing members 116 shown in FIGS. 12-18. The body support assembly biasing member 200 has a first end 202 that is fixedly connected to the housing 112, and a second end 204 that extends rearwardly past a bending surface 206 on a bending surface adjustment member 208. The bending surface adjustment member 208 is pivotally connected to the guide member 102 at a first connection 210. The bending surface adjustment member 208 is connected to the housing 112 by a second connection 212 which is a pin-and-slot connection that includes a pin 214 and a slot 216. The pin 214 is shown on the bending surface adjustment member 208 and the slot 216 is shown on the housing 112, however it is alternatively possible to provide the pin 214 on the housing 112 and to provide the slot 216 on the bending surface adjustment member 208. The bending surface adjustment member 208 is connected to the housing 112 by a third connection 218 which is a pin-and-slot connection that includes a pin 220 and a slot 222. The pin 220 is shown on the bending surface adjustment member 208 and the slot 222 is shown on the housing 112, however it is alternatively possible to provide the pin 220 on the housing 112 and to provide the slot 222 on the bending surface adjustment member 208.

When a user sits on the seat support member 108 the weight of the user generates downward movement of the housing 112 relative to the guide member 102. Thus, the first connection 210 moves upwards relative to the second connection 218. Because the pin 214 is positioned rearwardly of the pivot connection 210, the bending surface adjustment member 208 is driven to rotate counterclockwise in the view shown in FIGS. 19 and 20, which moves the bending surface 206 rearward. The movement of the bending surface 206 rearward changes the spring rate of the biasing member 200. The third connection 218 (i.e. the position of the pin 220 in the slot 222) simply follows the movement of the first and second connections as necessary during the rotation of the bending surface adjustment member 208.

When the user reclines the body support assembly 104, the biasing member 200 exerts a biasing force on the seat support member 108 at biasing force contact area 224. The biasing force is dependent on the spring rate in the biasing member 200 and also the amount of bending deflection is generated in the biasing member 200 by the seat support member 108. It will be noted in FIG. 11 that, in some embodiments as the seat support member 108 reclines there is a shift in the position of the biasing force contact area 224, which will affect the amount of deflection that is provided in the biasing member 200 by the seat support member 108. As a result, the spring rate of the biasing member 200 can change throughout the reclining movement of the body support assembly 104. The particular geometric relationship between the tilt control assembly 106, and the body support assembly 104 can be selected to affect the spring rate of the biasing member 200 as desired. In some embodiments the geometry may be selected so that the biasing force contact area 224 remains at a relatively constant distance from the bending surface 206 throughout the range of reclining of the body support assembly 104.

In the embodiment shown in FIGS. 19 and 20, the biasing member 200 has been shown to be in contact with the bending surface 206 when the chair is in the rest position (FIG. 19). Thus, the biasing member 200 is in contact with the bending surface 206 throughout the movement of the upper assembly 103 from the rest position to the weight-adjusted preloaded and unreclined position. In such embodiments, in order to reduce any frictional resistance between the biasing member 200 and the bending surface 206 and in the second connection 212, a roller (not shown) may be provided on the bending surface adjustment member 208 to act as the bending surface 206 and another roller (not shown) may be provided as the pin 214 that runs in the slot 216. In other embodiments, the biasing member 200 may be spaced from the bending surface 206 during some or all of the movement of the upper assembly 103 between the rest position and the weight-adjusted preloaded and unreclined position.

In the embodiment shown in FIGS. 19 and 20, a fastener 226 is shown connecting the front end of the seat support member 108 to the housing 112. A slot 228 is provided in the seat support member 108 to permit the sliding of the seat support member 108 relative to the fastener 226 while stabilizing the front end of the seat support member as it moves during reclining of the body support assembly 104. The fastener 226 and slot 228 could be provided in the embodiment shown in FIGS. 12-18 also.

As with the embodiment shown in FIGS. 12-18, in the embodiment shown in FIGS. 19 and 20 it is possible that front pivot links could be used in place of the slide surfaces 110.

In the embodiments shown in FIGS. 12-18 and 19-20, the movement of the guide member 102 and the housing 112 relative to each other is shown as being vertical, however they could move at a selected angle relative to each other in similar manner to the selected angle of movement between the guide member 58 and the housing 40 shown in FIGS. 10 and 11, to similar effect on the biasing force in the upper assembly biasing member 124 and which will affect the amount of movement that is generated in the bending surface 121 (FIG. 12-18) or 206 (FIGS. 19-20).

In the embodiments shown in FIGS. 12-18 and 19-20 it will be noted that the upper assembly biasing member 124 is shown as a leaf spring, however it could alternatively be one or more torsion springs, for example.

The paths travelled by the guide member relative to the housing in each of the embodiments shown has been linear, with some amount of vertical displacement. It will be noted, however, that it is alternatively possible for the path to be arcuate instead of linear. For example, the path may be circular and the shape of the guide member may be selected to have arced faces so as to run along such a path.

Figure 21:
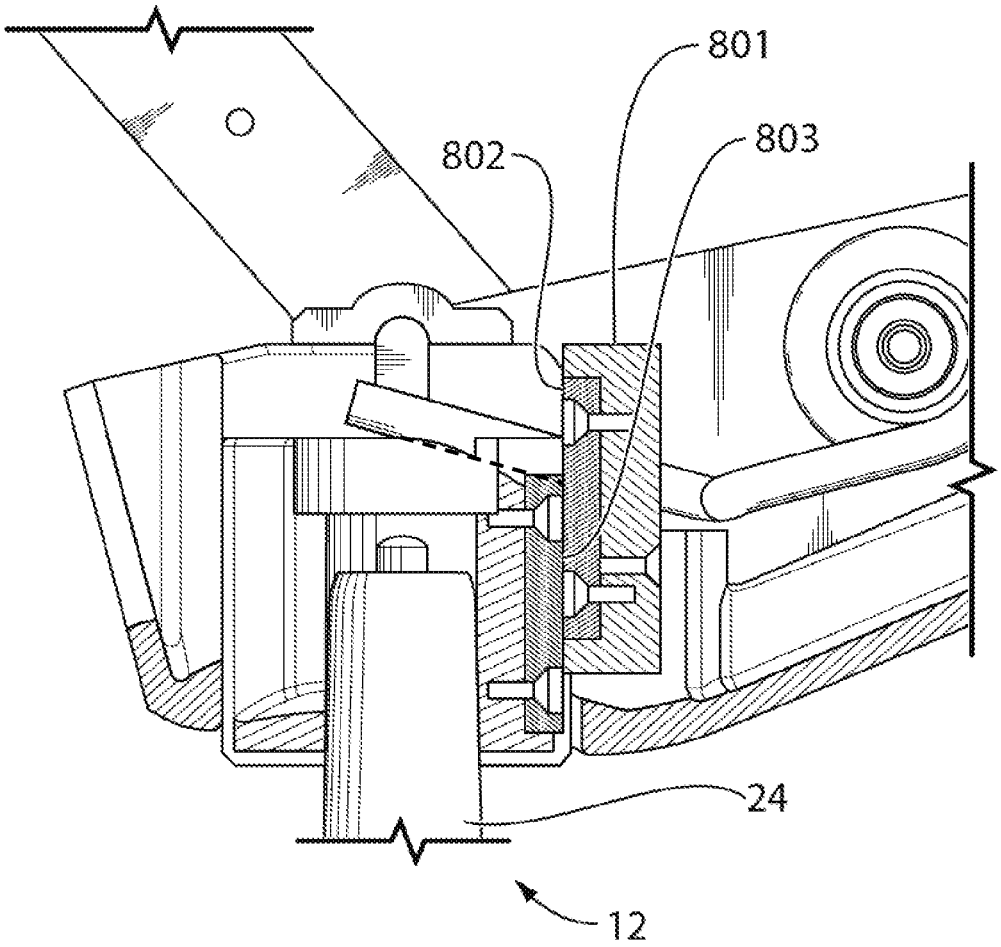
FIG. 21 is a sectional view of a variant of a locking mechanism for any of the chairs shown in FIGS. 1-20.

Reference is made to FIG. 21, which shows an alternative locking mechanism for any of the chairs shown herein. The locking mechanism shown in FIG. 21 includes a locking member 801 which holds a first pressure plate 802, the cams 76 as shown in FIG. 5, for example, and a second pressure plate 803. The first and second pressure plates 802 and 803 may have be made from any suitable high friction and wear resistant material, such as a high durometer rubber or a material that is a combination of plastic and rubber. A suitable durometer range may be, for example, between 90 and 95 durometer.

The locking member 48 with the teeth 78 thereon, the locking member biasing members 73, the cams 76 and the teeth 80 on the pedestal 12 together form a locking mechanism.

While the above description constitutes a plurality of embodiments of the present invention, it will be appreciated that the present invention is susceptible to further modification and change without departing from the fair meaning of the accompanying claims.

The invention claimed is:

1. A chair, comprising:

a pedestal;

an upper assembly that includes a body support assembly including a seat support member and a backrest, wherein the body support assembly is reclinable relative to the pedestal away from an unreclined position, wherein the upper assembly further includes a tilt control assembly including a housing that is movable relative to the pedestal;

a biasing member supported by the housing, the biasing member having a first end configured to sit atop a first end abutment surface that is a top surface of the pedestal, wherein the biasing member urges the upper assembly towards a rest position relative to the pedestal, and urges the body support assembly towards an unreclined position relative to the pedestal, wherein when the body support assembly is in the unreclined position and the upper assembly is in the rest position the biasing member has a selected preload;

wherein movement of the housing relative to the first end abutment surface, as a result of a downward force on the housing increases the preload in the biasing member; and a locking member supported by the housing, wherein the locking member is movable between an unlocked position wherein the locking member permits relative movement between the housing and the pedestal, and a locking position wherein the locking member prevents relative movement in at least one direction between the housing and the pedestal, wherein the body support assembly is operatively connected to the locking member such that reclining of the body support assembly from an unreclined position relative to the pedestal causes the locking member to move from the unlocked position to the locking position, and such that movement of the body support assembly to an unreclined position causes movement of the locking member to the unlocked position.

2. A chair as claimed in claim 1, wherein the chair further includes a locking member drive cam that is rotatable to a locking position to drive the locking member to the locking position, wherein the body support assembly is operatively connected to the locking member drive cam such that reclining of the body support assembly away from the unreclined position drives the locking member drive cam to the locking position.

3. A chair as claimed in claim 1, wherein the locking member is biased towards the unlocking position.

4. A chair as claimed in claim 1, wherein the seat support member has a front end that is movable relative to the tilt control assembly, and wherein a rear pivot link is connected at a first end to the housing of the tilt control assembly, and at a second end to a rear end of the seat support member, wherein the rear pivot link has a selected length to cause the rear end of the seat support member to drop in height at a selected rate compared to the front end of the seat support member, and wherein the backrest is connected fixedly to the rear pivot link.

* * * * *